US007156374B2

(12) United States Patent
Kataoka

(10) Patent No.: US 7,156,374 B2
(45) Date of Patent: Jan. 2, 2007

(54) CHAIN BLOCK

(75) Inventor: Iwao Kataoka, Amagasaki (JP)

(73) Assignee: HHH Manufacturing Co. (JP)

( * ) Notice: Subject to any disclaimer, the term of this patent is extended or adjusted under 35 U.S.C. 154(b) by 0 days.

(21) Appl. No.: 11/235,393

(22) Filed: Sep. 26, 2005

(65) Prior Publication Data

US 2006/0169962 A1 Aug. 3, 2006

(30) Foreign Application Priority Data

Sep. 27, 2004 (JP) ..... 2004-279523

(51) Int. Cl.
*B66D 1/30* (2006.01)

(52) U.S. Cl. ..... 254/372; 254/345; 74/575

(58) Field of Classification Search ..... 254/372, 254/358, 342, 345, 346, 365; 74/523, 575
See application file for complete search history.

(56) References Cited

U.S. PATENT DOCUMENTS 3,626,499 A * 12/1971 Iwama et al. ..... 254/345
4,251,060 A * 2/1981 Suzuki et al. ..... 254/356
4,420,144 A * 12/1983 Nishimura ..... 254/345
4,809,633 A * 3/1989 Santos ..... 114/210

FOREIGN PATENT DOCUMENTS

JP 06-115883 4/1994
JP 07-309591 11/1995

* cited by examiner

*Primary Examiner*—Emmanuel M. Marcelo
(74) *Attorney, Agent, or Firm*—Thompson Hine LLP

(57) ABSTRACT

A chain block comprising a load sheave winding up a load chain, a hand wheel arranged on one side of the load sheave and rotatable in one of a normal direction and a reverse direction in response to the manual operation of a hand chain, a pinion shaft inserted through the load sheave along the center axis of the load sheave in a manner allowing the load sheave to be freely rotatable thereabout, one end of the pinion shaft screwed into the center of the hand wheel and the other end of the pinion shaft including a spindle gear, a reduction gear composed of a small-diameter gear and a large-diameter gear, the large-diameter gear in mesh with the spindle gear, a main shaft gear, in mesh with the small-diameter gear, transferring a torque of the reduction gear to the load sheave.

3 Claims, 4 Drawing Sheets

PRIOR ART

CHAIN BLOCK

BACKGROUND OF THE INVENTION

1. Field of the Invention

The present invention relates to improvements of a chain block that winds up, unwinds, or pulls a load chain holding a load in response to a manual operation of a hand chain.

2. Description of the Related Art

Chain blocks typically raise and lower a load chain in a winding operation in response to the manual operation of a hand chain. FIG. 4 illustrates a typical structure of a chain block. A load sheave 50 is rotatably supported by bearings 52 at a main frame 51. A load chain (not shown) is wound up on the load sheave 50 to raise a load. A hand wheel 53 is rotatably supported on one side of the main frame 51 shown in the left-hand of FIG. 4. The hand wheel 53 transfers a force required to perform the winding operation to the load sheave 50. A hand chain (not shown) is wrapped around the hand wheel 53. By manually operating the hand chain, the force applied to the hand chain is transferred to the load sheave 50 via a transfer mechanism to be discussed later. The winding operation is performed to raise and lower the load. The transfer mechanism includes a pinion shaft 55, a reduction gear 56, and a main shaft gear 57. One end of the pinion shaft 55 is inserted into the center hole of the load sheave 50 in a manner such that the load sheave 50 is rotatable on the pinion shaft 55, and the other end of the pinion shaft 55 includes a spindle gear 54. The reduction gear 56, arranged on the side of the main frame 51 opposite from the hand wheel 53, includes a large-diameter gear **56*a* and a small-diameter gear 56*b* in a unitary body. The large-diameter gear 56*a* is in meshing engagement with the spindle gear 54. The small-diameter gear 56*b* of the reduction gear 56 is in meshing engagement with the main shaft gear 57. To reliably transfer the torque of the pinion shaft 55 to the main shaft gear 57, two reduction gears 56 are arranged on both sides of the center axis of the pinion shaft 55 (i.e., one in front of and the other behind the plane of the page of FIG. 4). Alternatively, the two reduction gears 56 may be arranged, one above and the other below the center axis of the pinion shaft 55. The main shaft gear 57 is connected to the load sheave 50 by lock pins 58 so that the main shaft gear 57 integrally rotates with the load sheave 50. A ratchet gear 60 is arranged between the hand wheel 53 and the load sheave 50. The ratchet gear 60 is engaged with a ratchet pawl 59 to prevent the hand wheel 53 from rotating in a reverse direction. A fixed friction plate 62 is arranged next to the ratchet gear 60 so that the fixed friction plate 62 is frictionally engaged with a brake lining 61 on the ratchet gear 60. Lock pins 63 connect the fixed friction plate 62 to the pinion shaft 55 so that the fixed friction plate 62** is restricted in rotation and in axial movement.

When the hand wheel 53 is rotated by manually operating the hand chain in the chain block thus constructed, the force applied to the hand chain is transferred to the fixed friction plate 62 and the pinion shaft 55 via the brake lining 61 so that the fixed friction plate 62 and the pinion shaft 55 integrally rotate. The torque of the pinion shaft 55 is further transferred to the main shaft gear 57 via the spindle gear 54 and the reduction gear 56. As a result, the load sheave 50 rotates, thereby performing the winding operation on the load chain.

Japanese Unexamined Patent Application Publications Nos. 6-115883 and 7-309591 disclose techniques that allow a load sheave corresponding to a load chain in a chain-lever hoist to freely rotate with no load applied.

In this type of the chain block, the load chain is preferably free to move with no load applied. The chain block is typically used at an elevated location, and cannot be directly operated. The chain block has no mechanism to allow free rotation. To perform the winding operation of the load chain with no load applied, the hand chain needs to be repeatedly moved with the reduction gear applied. A lot of energy is required to perform the winding job.

SUMMARY OF THE INVENTION

Accordingly, it is an object of the present invention to provide a chain block that allows a load sheave to freely rotate in no-load conditions.

In accordance with one embodiment of the present invention, a chain block includes a load sheave winding up a load chain having a load attached thereto, a hand wheel that is arranged on one side of the load sheave and rotatable in one of a normal direction and a reverse direction in response to the manual operation of a hand chain, a pinion shaft that is inserted through the load sheave along the center axis of the load sheave in a manner that allows the load sheave to be freely rotatable thereabout, one end of the pinion shaft screwed into the center of the hand wheel and the other end of the pinion shaft including a spindle gear, a reduction gear composed of a small-diameter gear and a large-diameter gear in a unitary body, the large-diameter gear in meshing engagement with the spindle gear, a main shaft gear, in meshing engagement with the small-diameter gear, transferring a torque of the reduction gear to the load sheave. When the hand wheel is rotated in a load lowering direction with the load sheave in no-load condition, the pinion shaft moves in the direction of axis in response to the rotation of the hand wheel until the pinion gear is disengaged from the reduction gear.

In accordance with the embodiment of the present invention, the hand wheel is rotated in the reverse direction (to lower a load) with the load sheave in no-load condition. The hand wheel is thus rotated at a fixed location. The pinion shaft with the one end screwed into the hand wheel axially moves by means of screw engagement, thereby disengaging the spindle gear on the other end from the large-diameter gear portion of the reduction gear. In that condition, the load sheave is free to rotate and the load chain is directly lowered. The no-load condition refers to not only a complete no-load condition, but also a state of the hand wheel that is free to rotate at a fixed location. For example, a suspension hook is attached to the load chain. Although the weight of the suspension hook is not zero, this state is referred to as no-load condition. With a load applied to the load sheave, the hand chain is rotated in a wind-up direction (normal direction). The pinion shaft moves in a reverse direction, causing the spindle gear to be engaged with the reduction gear.

In a preferred embodiment, the chain block further includes a ratchet gear arranged between the hand wheel and the load sheave to prevent the hand wheel from rotating in the reverse direction.

In another preferred embodiment, the chain block further includes a fixed friction plate arranged between the ratchet gear and the load sheave, the fixed friction plate engaged with a brake lining arranged on the ratchet gear.

In accordance with embodiments of the present invention, the pinion shaft is moved in response to the rotation of the hand wheel to a position where the pinion gear is disengaged from the reduction gear when the hand wheel is rotated in the load lowering direction in no-load condition. The hand chain operating in the no-load condition shifts the load sheave to a free-to-rotate state. With the ratchet gear arranged between the hand wheel and the load sheave to prevent the hand wheel from rotating in the reverse direction, the hand wheel is prevented from rotating in the reverse direction in a perfunctory manner during a load raising operation and a load lowering operation. Safety of operators is thus enhanced. With the fixed friction plate, arranged between the ratchet gear and the load sheave, in the frictional engagement with the brake lining on the ratchet gear, the load raising operation and load lowering operation are performed slowly due to the frictional engagement. The ease of use of the chain block is thus assured.

DESCRIPTION OF THE PREFERRED EMBODIMENTS

Figure 1:
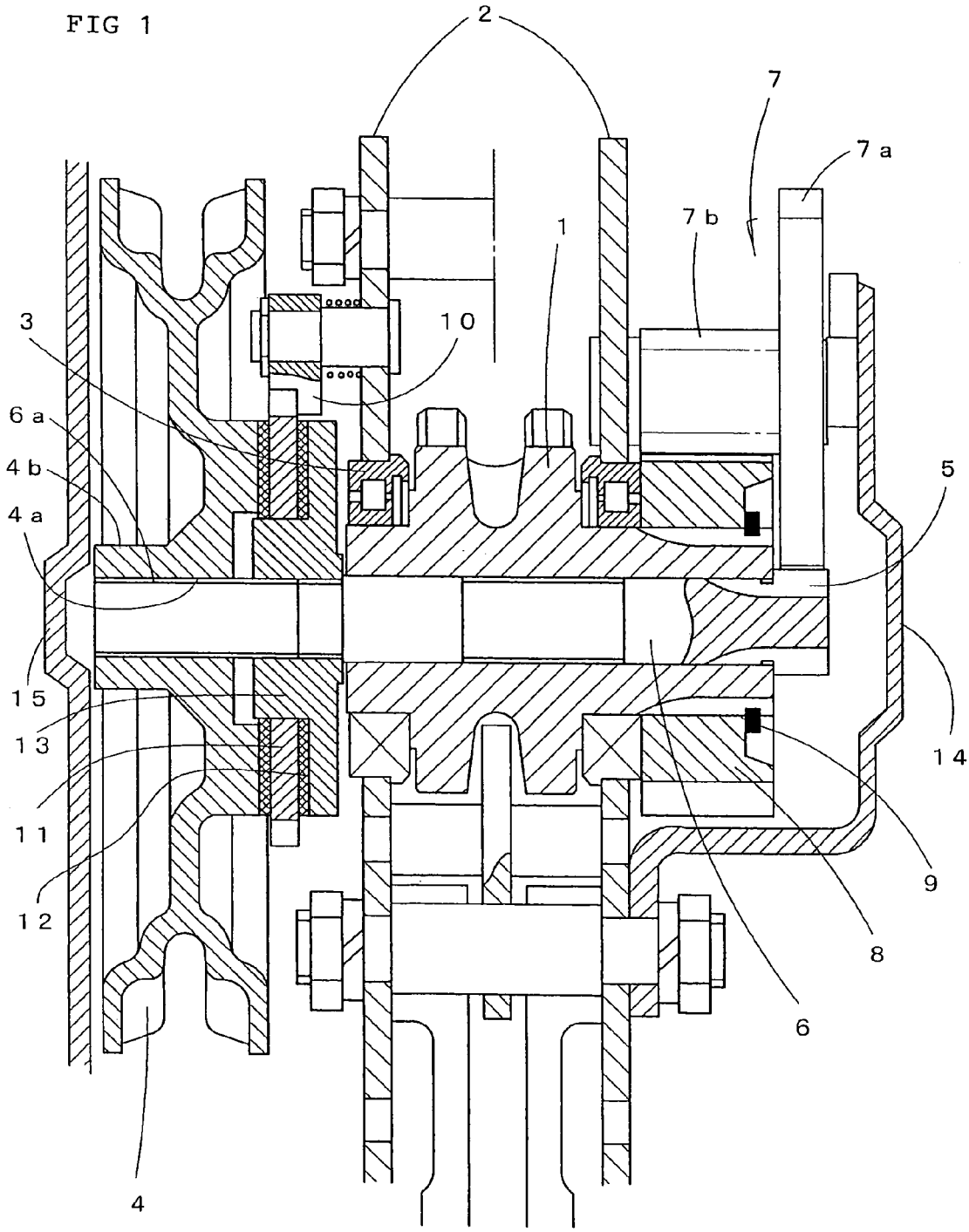
FIG. 1 is a cross-sectional view of a chain block in a wind-up state in accordance with one embodiment of the present invention.

The embodiments of the present invention are described below with reference to the drawings. FIG. 1 is a cross-sectional view illustrating a major portion of a chain block of one embodiment of the present invention. A load sheave 1 is rotatably supported by bearings 3 at a main frame 2. A load chain (not shown) is wound up on the load sheave 1 to raise a load. A hand wheel 4 is rotatably supported on one side of the main frame 2 shown in the left-hand of FIG. 1. The hand wheel 4 transfers a force required to perform the winding operation to the load sheave 1. A hand chain (not shown) is wrapped around the hand wheel 4. By manually operating the hand chain, the force applied to the hand chain is transferred to the load sheave 1 via a transfer mechanism to be discussed later. The winding operation is performed to raise and lower the load.

Figure 2:
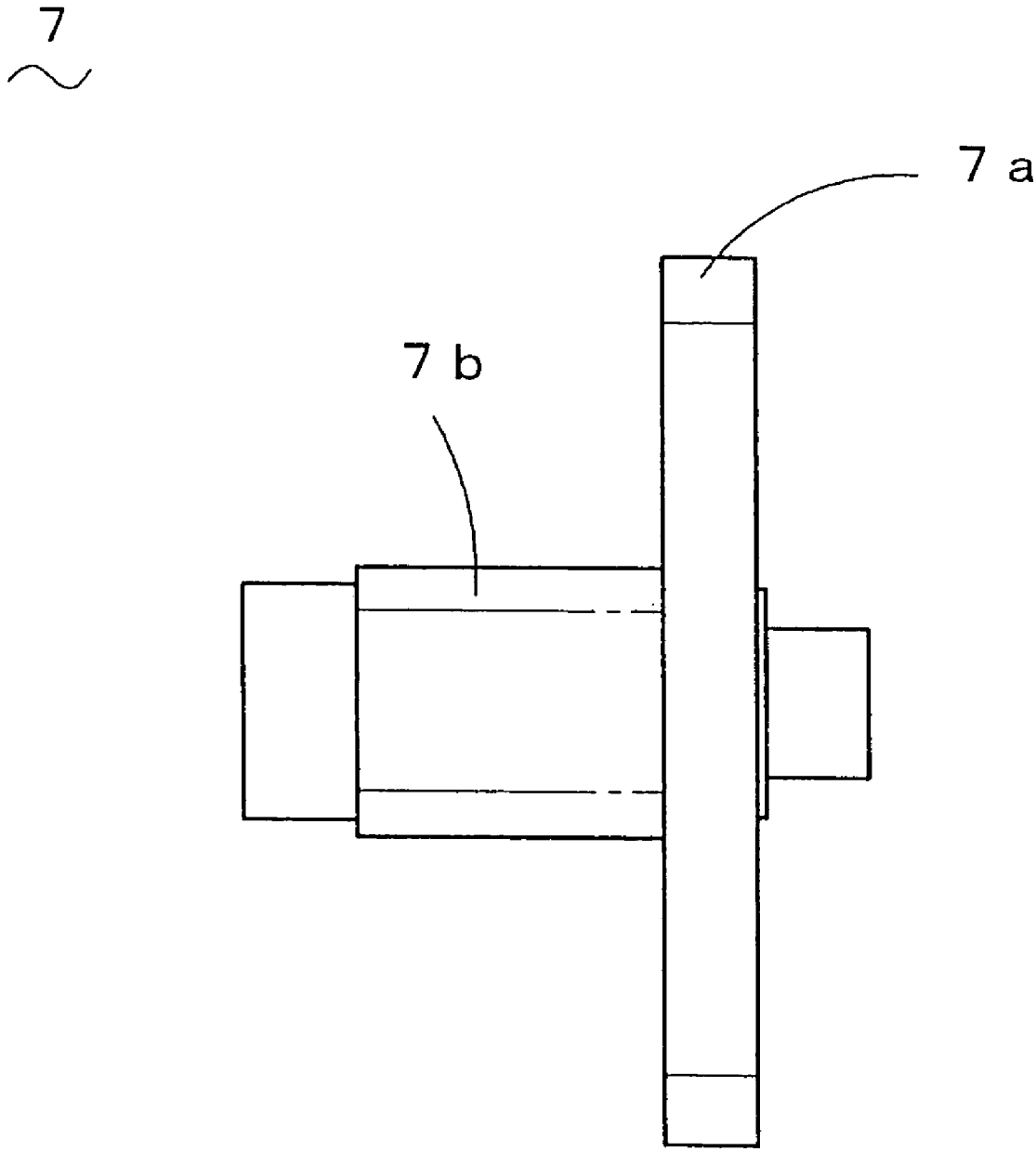
FIG. 2 is a side view of a reduction gear in accordance with the embodiment of the present invention.

The transfer mechanism includes a pinion shaft 6, a reduction gear 7, and a main shaft gear 8. The pinion shaft is inserted through the load sheave 1 in alignment with the center axis of the load sheave 1 in a free-to-rotate manner. A male thread 6*a* on one end the pinion shaft 6 is in meshing engagement with a female thread 4*a* at the center of the hand wheel 4. The other end of the pinion shaft 6 includes a spindle gear 5. The reduction gear 7, arranged on the side of the main frame 2 opposite from the hand wheel 4, includes a large-diameter gear 7*a* and a small-diameter gear 7*b* in a unitary body as shown in FIG. 2. The large-diameter gear 7*a* is in meshing engagement with the spindle gear 5. The small-diameter gear 7*b* of the reduction gear 56 is in meshing engagement with the main shaft gear 8. The main shaft gear 8 is connected to the load sheave 1 by lock pins 9 so that the main shaft gear 8 integrally rotates with the load sheave 1. To reliably transfer the torque of the pinion shaft 6 to the main shaft gear 8, two reduction gears 7 are arranged on both sides of the center axis of the pinion shaft 6 (i.e., one in front of and the other behind the plane of the page of FIG. 1). Alternatively, the two reduction gears 7 may be arranged, one above and the other below the center axis of the pinion shaft 6.

A ratchet gear 11 is arranged between the hand wheel 4 and the load sheave 1. The ratchet gear 11 is engaged with a ratchet pawl 10 to prevent the hand wheel 4 from rotating in a reverse direction. A fixed friction plate 13 is arranged next to the ratchet gear 11 so that the fixed friction plate 13 is frictionally engaged with a brake lining 12 on the ratchet gear 11.

To raise and lower a load with the chain block thus constructed, the hand chain is manually operated to rotate the hand wheel 4. The torque of the hand wheel 4 is transferred to the pinion shaft 6 and the spindle gear 5. The torque of the spindle gear 5 is transferred to the load sheave 1 via the reduction gear 7. The load sheave 1 is thus rotated, winding up the load chain wrapped around the load sheave 1.

Figure 3:
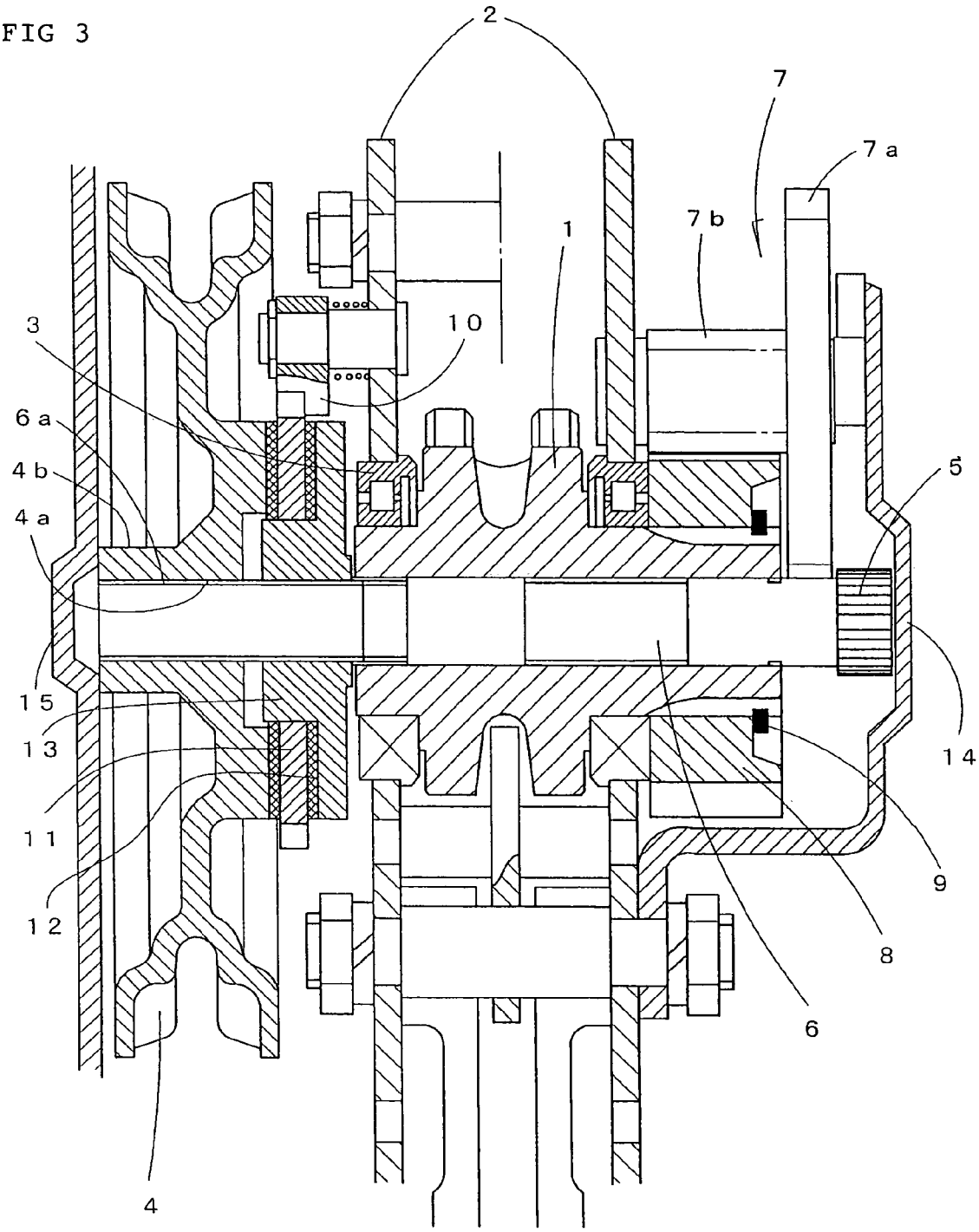
FIG. 3 is a cross-sectional view of the chain block in a free-to-rotate state in accordance with the embodiment of the present invention.
Figure 4:
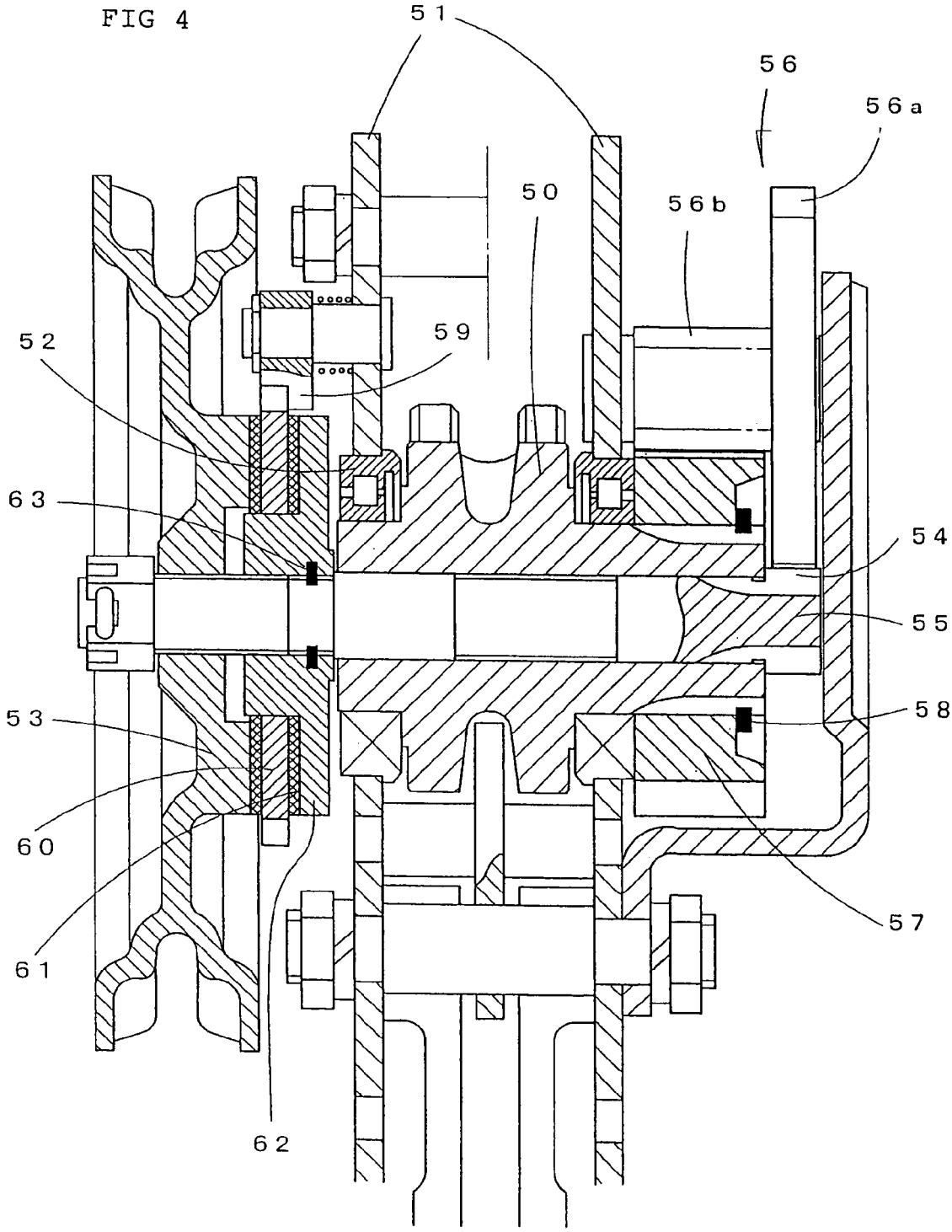
FIG. 4 is a cross-sectional view of a known chain block.

To allow the load sheave 1 to rotate freely in the no-load condition, the spindle gear 5 is disengaged from the reduction gear 7. More specifically, if the hand chain is pulled in the load lowering direction with no load applied to the load sheave 1, the hand wheel 4 with the hand chain wrapped therearound slides along the brake lining 12 because the force in the load lowering direction becomes larger than a frictional force with the brake lining 12. The hand wheel 4 recedes to a location where a projected ring 4*b* of the hand wheel 4 is engaged with a side cover 15. If the hand chain is pulled with the projected ring 4*b* engaged with the side cover 15, the hand wheel 4 freely rotates at a fixed position, namely, at an engagement position. In response to the rotation, the pinion shaft 6 with the thread engaged with the hand wheel 4 axially moves by means of screw engagement. As the pinion shaft 6 moves, the spindle gear 5 is disengaged from the reduction gear 7 (large-diameter gear 7*a*) as shown in FIG. 3. The load sheave 1 becomes free to rotate.

If the hand chain is pulled in an opposite direction, namely, in the wind-up direction, the projected ring 4*b* moves from the side cover 15. The hand wheel 4 returns back to a frictional state with the brake lining 12. If the hand chain is further pulled in the opposite direction, the pinion shaft 6 axially moves in the opposite direction. The spindle gear 5 resumes the engagement state with the reduction gear 7. The load sheave 1 is now ready to wind up the load.

The larger the pitch of the female thread 4*a* of the hand wheel 4 and the male thread 6*a* of the pinion shaft 6, the greater distance the pinion shaft 6 moves with a smaller number of rotation (angle of rotation). The switching operation between the winding operation and the free-to-rotate operation is quickly performed. The present invention is not limited to any particular pitch. If the hand wheel 4 is continuously rotated during the free-to-rotate state, the pinion shaft 6 comes off. For this reason, a cover plate 14 is arranged on the side of the spindle gear 5. With the cover plate 14 in contact with the pinion gear 5, the pinion gear 6 is prevented from coming off. The present invention is not limited to this type of mechanism to prevent the pinion gear 6 from coming off. A radially extending pin is arranged on a rear end of the female thread 6*a* of the pinion gear 6. The movement of the pining gear 6 may be restrained so that the pin does not enter the center of the hand wheel 4.

By pulling the hand chain in the load raising direction again in the load sheave 1 in the free-to-rotate state, the pinion shaft 6 returns to the state of FIG. 1. The spindle gear 5 is engaged with the large-diameter gear 7*a* of the reduction gear 7, thereby shifting the transfer mechanism of the hand wheel 4 and the load sheave 1 into the connection state.

What is claimed is:

1. A chain block comprising a load sheave winding up a load chain having a load attached thereto, a hand wheel that is arranged on one side of the load sheave and rotatable in one of a normal direction and a reverse direction in response to the manual operation of a hand chain, a pinion shaft that is inserted through the load sheave along the center axis of the load sheave in a manner that allows the load sheave to be freely rotatable thereabout, one end of the pinion shaft screwed into the center of the hand wheel and the other end of the pinion shaft including a spindle gear, a reduction gear composed of a small-diameter gear and a large-diameter gear in a unitary body, the large-diameter gear in meshing engagement with the spindle gear, a main shaft gear, in meshing engagement with the small-diameter gear, transferring a torque of the reduction gear to the load sheave, wherein when the hand wheel is rotated in a load lowering direction with the load sheave in no-load condition, the pinion shaft moves in the direction of axis in response to the rotation of the hand wheel until the pinion gear is disengaged from the reduction gear.

2. The chain block according to claim 1, further comprising a ratchet gear arranged between the hand wheel and the load sheave to prevent the hand wheel from rotating in the reverse direction.

3. The chain block according to claim 2, further comprising a fixed friction plate arranged between the ratchet gear and the load sheave, the fixed friction plate engaged with a brake lining arranged on the ratchet gear.

* * * * *